US005429688A

United States Patent [19]

Barbosa et al.

[11] Patent Number: 5,429,688

[45] Date of Patent: Jul. 4, 1995

[54] WORK HARDENED STAINLESS STEEL FOR SPRINGS

[76] Inventors: Celso A. Barbosa, Albuquerque Lins St. 634/146, Santa Cecilia, Brazil, 01230; Marcelo B. Tessler, Caso do Ator St. 782/14, Villa Olimpia, Sao Paulo, Brazil, 04546

[21] Appl. No.: 137,057

[22] PCT Filed: Feb. 19, 1993

[86] PCT No.: PCT/BR93/00006

§ 371 Date: Oct. 26, 1993

§ 102(e) Date: Oct. 26, 1993

[87] PCT Pub. No.: WO93/17144

PCT Pub. Date: Sep. 2, 1993

[30] Foreign Application Priority Data

Feb. 27, 1992 [BR] Brazil ..... 9200797

[51] Int. Cl.[6] ..... C22C 38/44

[52] U.S. Cl. ..... 148/327; 148/908

[58] Field of Search ..... 148/327, 908; 420/59, 420/52

[56] References Cited

U.S. PATENT DOCUMENTS 5,314,549 5/1994 Misao et al. ..... 148/327

FOREIGN PATENT DOCUMENTS 63-134627 6/1988 Japan ..... 148/327

*Primary Examiner*—Deborah Yee

*Attorney, Agent, or Firm*—Hoffman, Wasson & Gitler

[57] ABSTRACT

A metastable austenitic, cold deformed "work hardened stainless steel for springs", with 17.0 to 19.0% Cr, 8.0 to 10.0% Ni, up to 0.03% C, 0.006 to 0.16% N, up to 1.0% Si, 1.0 to 2.0% Mn, up to 0.8% Mo, up to 0.045% P, up to 0.030% S, iron (Fe) and residuals, the alloy being used for spring manufacture, exhibiting good resistance to corrosion after cold deformation, exhibiting high mechanical properties and better resistance to corrosion than UNS S30200 steel, even when exposed to a tempered heat treatment. The steel is appropriate for use as wire rod, bars, wires, sheets and strip forms.

3 Claims, No Drawings

WORK HARDENED STAINLESS STEEL FOR SPRINGS

BACKGROUND OF THE INVENTION

1. Technical Field

The current invention relates to an improved stainless steel obtained by cold deformation, such as wire drawing and rolling. As a result, the steel provides a structure, made up of martensite and austenite, with high resistance to corrosion. Such properties suit its main application in the field of spring manufacture.

2. Background of the Art

Springs are submitted to a load cycle, and therefore require good fatigue resistance. A number of factors affect this resistance, but it is the superficial quality, without any doubt, that most regulates the spring's performance when submitted to fatigue conditions. The presence of superficial irregularities favors the nucleation of fatigue cracks. Nevertheless, resistance to fatigue is not guaranteed just by avoiding these defects, because superficial defects can be formed during spring use. One of the most prejudicial superficial defects created during spring use is corrosion. So, when the design conditions demand and the costs permit, stainless steel should be used in the manufacture of springs.

Stainless steel for springs was developed in order to increase the mechanical strength of springs, which was very low in the solubilized condition. Compositions that allow for hardening mechanisms and strength levels that exceed 2000 MPa, in some alloys and gauge, were developed. In addition, stainless steel provides the capacity to be cold worked, which eases the manufacturing process such as rolling and drawing.

Stainless steels that form martensite during cold deformation are called metastable. They provide high strength after cold deformation, as occurs during wires drawing, so they are the main stainless steels Used in spring manufacture. Strength is the result of a microstructure consisting of hardened martensite and austenite, having carbon as the main hardening element.

However, metastable austenitic stainless steel, or the current technical state, most used in spring manufacture, UNS S30200 steel, with up to 0.15% of C, 17.0 to 19.0% Cr, 8.0 to 10.0% Ni, up to 0.75% Si, up to 2.0% Mn, up to 0.045% P and up to 0.030% S, does not provide enough resistance to intergranular and pitting corrosion. Besides, due to the high carbon content, normally over 0.08%, these steels most be heat treated in a cycle known as solubilization, at higher temperatures and longer periods than other stainless steels. So, working with UNS S30200 steel involves more care and higher cost.

Also, the standard stainless steel for springs provides problems in durability when used in applications that require high resistance to corrosion. In the spring manufacturing process, a tempering heat treatment is normally carried out in order to increase the spring strength and durability. Depending on the temperature used, chromium carbide precipitation can occur, which reduces the resistance to corrosion.

The current invention solves these problems.

DETAILED DESCRIPTION OF THE INVENTION

The object of this invention is to produce a cold deformed stainless steel composition for spring manufacture, with a microstructure composed of a mixture of martensite and austenite, which yields better resistance to intergranular and pitting corrosion and does not require special care for solution heat treatment.

Specifically, the current invention provides a metastable stainless steel for spring manufacture that, after cold deformation, has a microstructure composed of austenite and martensite. This steel has 17.0 to 19.0% Cr, 8.0 to 10.0% Ni, 0.06 to 0.16% N, up to 0.03% up to 1.0% Si, 1.0 to 2.0% Mn, up to 0.80% Mo, up to 0.075% P and up to 0.030% S; the rest is iron and inevitable impurity.

The stainless steel according to the current invention provides high strength after cold deformation and high resistance to intergranular and pitting corrosion. Besides, the solution heat treatment of this steel does not involve special care, and can be eventually eliminated.

The chemical composition range of the new steel must have hardening properties similar to UNS S30200, where the high resistance is a result of the martensite formation during the cold deformation when drawing or rolling occurs, and the hardening by carbon.

The martensite level created depends on the alloy stability degree, which is a function of chemical composition. One of the equations that rules this dependence is the following:

$$Md(30/50)\ (^\circ C.)=497-462|(\%\ C)+(\%\ N)|-9.2(\%\ Si)-8.1(\%\ Mn)-13.7(\%\ Cr)-20(\%Ni)-18.8(\%\ Mo)$$

where Md (30/50) is temperature, in degrees Celsius (centigrade), that occurs in the formation of 30% martensite, after 50% cold deformation.

A typical composition of UNS S30200 steel used by experts consists of 0.10% C, 0.40% Si, 1.70% Mn, 17.5% Cr, 8.3% Ni, 0.03% N and 0.4% Mo. Using the above equation will result in Md (30/50) equal to 6.34° C. The alloy of this current invention must have the same content of the Cr, Ni, Si, Mn and Mo elements present in UNS S30200. Supposing a carbon content equal to 0.02% (the required specification is up to 0.03%) and calculating the Md (30/50) for the new alloy, obtained is:

$$Md(30/50)=57.16-462(\%\ N).$$

For the new alloy to have an equivalent martensite value, after cold deformation, to UNS S30200, its Md (30/50) must be the same, which involves a desirable typical content of 0.11% nitrogen.

In relation to hardening effect, the nitrogen is at least as efficient as carbon, because the nitrogen interactions with the dislocations are much stronger than those obtained with carbon.

The reason for the current stainless steel chemical composition specification is described as follows:

Cr: 17.0% to 19.0%—Chromium is the essential element to promote resistance to corrosion through a superficial protector layer formation turning the steel stainless.

Ni: 8.0% to 10.0%—Nickel is the element that provides stability to austenite and resistance to corrosion. Its content should be balanced with chromium content to guarantee a starting microstructure completely austenitic after the solution heat treatment or the rolling. Besides, the composition range must be stabilized in order for the martensite formation to occur after cold deformation.

C: up to 0.03%—Carbon is a gamagenic element that is dissolved when its concentration is low. However, when the C content increases, the M23C6 carbide type can precipitate in grain boundaries, consuming chromium that is useful to intergranular corrosion resistance. In the current invention the limit of this element, at most 0.03%, will be compensated, as will be seen below, by the nitrogen content.

N: 0.06% to 0.16%—Nitrogen is the most critical element of the current invention and is particularly important to obtain simultaneously the mechanical properties necessary for stainless steel spring manufacture with improved resistance to corrosion. The nitrogen works as a stabilizer of the austenitic phase and as a hardener. During cold deformation, the nitrogen hardens the formed martensite, assuring a high work hardening behavior. This element increases the resistance to pitting corrosion and delays the kinetics of M23C6 precipitation, increasing, therefore, the resistance to intergranular corrosion. After heat treatment of the hardened material, by cold drawing or rolling, the nitrogen creates an atmosphere in the vicinity of the dislocations, raising still more the steel, strength. The effect can not be obtained with a nitrogen content below 0.06%; on the other hand, it can not be over 0.16% because the Md (30/50) value reaches values that damage the alloy metastability, and as a result, the mechanical property levels reached.

Si: up to 1.0%—Silicon is a deoxidizing element and its presence is related with the Steel manufacturing process.

Mn: 1.0% to 2.0%—manganese is a gamagenic element and helps to assure a completely austenitic structure after solution heat treatment. The manganese is also used in steel deoxidation.

P, S and other residual elements inevitably mixed up in the steel manufacturing process, should be at the lowest levels possible.

The alloy, as described, can be manufactured as rolling or forged products by a standard or a special process, such as powder metallurgy or continuous casting wire rod, bars, wires, sheets and strips.

In the following Example, the steel properties of the current invention will be described and compared with those of the UNS S30200 steel.

EXAMPLE

In Table 1, displayed is a comparison of alloys that were casted and rolled to 8 millimeter diameter wire rod and solubilized. The materials were cold deformed by wire drawing up to a 3.0 millimeter diameter wire, and in each, reduction samples were taken. In Table 2, the work hardening behavior of the two steels is displayed. The new steel presents sufficient metastability to reach high levels of strength necessary for spring application. In spite of situations where the strength values of the current invention are below the values obtained for UNS S30200, it can be seen in the Example that they still meet the minimum levels required by the standards that establish spring manufacture from drawn wires. The spring, during its manufacturing, is submitted to a tempering heat treatment at temperatures around 400° C. Table 3 displays that the new steel presents, in its final condition, more hardening than the UNS S30200 steel, showing the effective action of nitrogen as a hardening element.

The mechanical properties of the starting material, solubilized wire rod with an 8.0 millimeter diameter, are shown in Table 4. The alloy in the current invention has a greater yield strength and the same ductility as the UNS S30200 steel. There is no difference in the tensile strength.

Some pitting corrosion tests were conducted in the solubilized material and in the wire, with 82% deformation. The tests were conducted according to ASTM G48 rule, mass loss in a ferric chloride solution after 72h. The results are displayed in Table 5. It is clear that the new steel is superior to UNS S30200 in terms of resistance to pitting corrosion, maintaining this benefit in the work hardened condition as well. The results confirm the strong effect of nitrogen in resistance to pitting corrosion.

The tests of intergranular corrosion were also conducted in the solubilized material, in the==wire with 82% deformation, and in the wire after treatment at 400° C. during 40 minutes. The test was conducted according to ASTM A 262-C rule, mass loss in boiling nitric acid. The results are displayed in Table 6. In all conditions, the steel of the present invention was superior to UNS S30200 steel. The difference was greater after treatment at 400° C. during 40 minutes, due to precipitation of carbide in grain boundaries in the UNS S30200 steel. One must be aware of the fact that, in the current Example, the UNS S30200 steel was solubilized (1060° C. during 3h). One fault in the UNS S30200 steel solution heat treatment reduces its resistance to intergranular corrosion. Even in the as rolled condition, the wire rod of the current invention did not present intergranular corrosion.

To evaluate fatigue life, springs were manufactured from drawn wires of 1.0 mm diameter. The manufacturing process was conducted under the same conditions normally used for UNS S30200 steel. The springs made with the two steels were tested in compression, with load varying from 287N to 988N, according to DIN 2089 standard. The steel of the current invention showed a fatigue life, up to breakage, of 120,000 cycles, as compared to 80,000 cycles of UNS S30200 steel.

It will be obvious to experts that the principles of the invention, herein described in relation to a specific Example, will allow for many other changes and applications. It is also desirable that, when analyzing the scope of the appended claims, they not be limited to the specific Example of the invention herein described.

The following Tables were referred to in the EXAMPLE:

TABLE 1

| | CHEMICAL COMPOSITION IN WEIGHT PERCENTAGES | | | | | | | | | |
|---|---|---|---|---|---|---|---|---|---|---|
| ALLOY | Cr | Ni | Mn | Si | N | C | Mo | Cu | P | S |
| UNS S30200 | 18.1 | 8.72 | 1.42 | 0.60 | 0.041 | 0.08 | 0.09 | 0.1 | 0.027 | 0.014 |
| Steel of the Invention | 17.45 | 8.21 | 1.88 | 0.45 | 0.10 | 0.01 | 0.35 | 0.18 | 0.03 | 0.024 |

TABLE 2

WORK HARDENING BEHAVIOR

| Reduction (%) | Tensile Strength (MPa) 0 | 35 | 52 | 59 | 68 | 75 | 80 | 82 |
|---|---|---|---|---|---|---|---|---|
| Steel of the Invention | 595 | 935 | 1190 | 1345 | 1455 | 1595 | 1640 | 1755 |
| UNS S30200 | 600 | 940 | 1210 | 1400 | 1580 | 1690 | 1780 | 1820 |

TABLE 3

WIRE HARDENING AFTER ANNEALING

| Material | Condition | Hardness (HV1) |
|---|---|---|
| Steel of the Invention | 82% deformed | 463 |
| | 82% deformed + 400° C. × 40 min. | 547 |
| UNS S30200 | 82% deformed | 485 |
| | 82% deformed + 400° C. × 40 min. | 517 |

TABLE 4

MECHANICAL PROPERTIES OF THE SOLUBILIZED WIRE ROD TEST TEMPERATURE 25° C. AND $\epsilon = 0.001\ s^{-1}$

| | Steel of the Invention | UNS S30200 |
|---|---|---|
| Yield Strength 0.2% (MPa) | 332.1 | 254.6 |
| Tensile Strength (MPa) | 654.5 | 653.9 |
| Elongation 5d (%) | 78.6 | 83.1 |
| Reduction in area (%) | 79.7 | 79.3 |

TABLE 5

PITTING CORROSION TESTS RESULTS - ASTM G48

| Material | Condition | Mass Loss (mg/cm$^2$) |
|---|---|---|
| Steel of the Invention | solubilized | 24.06 |
| | 82% deformed | 44.03 |
| UNS S30200 | solubilized | 46.15 |
| | 82% deformed | 56.38 |

TABLE 6

INTERGRANULAR CORROSION TESTS RESULTS - ASTM A262-C

| Material | Condition | Mass Loss (μg/cm$^2$) |
|---|---|---|
| Steel of the Invention | solubilized | 1160 |
| | 82% deformed | 1420 |
| | 82% deformed + 400° C./40 min. | 1660 |
| UNS S30200 | solubilized | 1300 |
| | 82% deformed | 1640 |
| | 82% deformed + 400° C./40 min. | 5070 |

We claim:

1. A work hardened stainless steel alloy for springs having a microstructure of martensite and austenite and a composition comprising the following components in weight percentage: $17.0 \leqq Cr \leqq 19.0$; $8.0 \leqq Ni \leqq 10.0$; $0 < C \leqq 0.03$; $0.06 \leqq N \leqq 0.16$; $0 < Si \leqq 1.0$; $1.0 \leqq Mn \leqq 2.0$; $0 < Mo \leqq 0.8$; $0 < P \leqq 0.045$; $0 < S \leqq 0.030$; and the balance being Fe wherein the composition exhibits a high resistance to corrosion after cold deformation.

2. A work hardened stainless steel alloy and a composition in accordance with claim 1, further comprising inevitable residual impurities.

3. A work hardened stainless steel alloy and a composition in accordance with claim 1, wherein said composition is subjected to a tempering heat treatment to increase the mechanical properties of said composition.

* * * * *